US008969423B2

(12) United States Patent
Eastland et al.

(10) Patent No.: US 8,969,423 B2
(45) Date of Patent: Mar. 3, 2015

(54) PROCESS FOR THE PRODUCTION OF SUBSTITUTE NATURAL GAS

(75) Inventors: Philip Henry Donald Eastland, London (GB); Jonathan Geoffrey Gavin, London (GB); David Andrew Walker, London (GB)

(73) Assignee: Davy Process Technology Limited, London (GB)

( * ) Notice: Subject to any disclaimer, the term of this patent is extended or adjusted under 35 U.S.C. 154(b) by 26 days.

(21) Appl. No.: 13/805,940

(22) PCT Filed: Jun. 27, 2011

(86) PCT No.: PCT/GB2011/051215
§ 371 (c)(1),
(2), (4) Date: Mar. 19, 2013

(87) PCT Pub. No.: WO2012/001401
PCT Pub. Date: Jan. 5, 2012

(65) Prior Publication Data

US 2013/0210938 A1 Aug. 15, 2013

(30) Foreign Application Priority Data

Jul. 1, 2010 (GB) ..... 1011063.3

(51) Int. Cl.
*C10L 3/08* (2006.01)

(52) U.S. Cl.
CPC ..... *C10L 3/08* (2013.01)
USPC ..... 518/705

(58) Field of Classification Search
None
See application file for complete search history.

(56) References Cited

U.S. PATENT DOCUMENTS

| | | | |
|---|---|---|---|
| 4,016,189 | A | 4/1977 | Muller et al. |
| 4,133,825 | A | 1/1979 | Stroud et al. |
| 4,205,961 | A | 6/1980 | Moller et al. |
| 4,298,694 | A | 11/1981 | Skov |
| 2009/0247653 | A1 | 10/2009 | Ravikumar et al. |
| 2009/0264542 | A1 | 10/2009 | Filippi et al. |

FOREIGN PATENT DOCUMENTS

| | | |
|---|---|---|
| CN | 101560134 | 10/2009 |
| CN | 101705128 | 5/2010 |
| CN | 101812339 A | 8/2010 |
| WO | 2010033848 A2 | 3/2010 |

OTHER PUBLICATIONS

Maria Sudiro and Alberto Bertucco (Aug. 2010). Synthetic Natural Gas (SNG) from Coal and Biomass: a Survey of Existing Process Technologies, Open Issues and Perspectives. ISBN: 978-953-307-112-1, InTech.*

International Search Report and Written Opinion for PCT/GB2011/051215, dated Sep. 16, 2011, 10 pages.

International Preliminary Report on Patentability for PCT/GB2011/051215, dated Jan. 25, 2013, 8 pages.

* cited by examiner

*Primary Examiner* — Jafar Parsa
*Assistant Examiner* — Amy C Bonaparte
(74) *Attorney, Agent, or Firm* — Armstrong Teasdale LLP

(57) ABSTRACT

In a process for the production of substitute natural gas, a feed gas is provided to a first and/or second and/or subsequent bulk methanator. The feed gas is subjected to methanation in the presence of a suitable catalyst. An at least partially reacted stream from the first bulk methanator is removed and supplied to the second and/or subsequent bulk methanator where it is subjected to further methanation. A product stream from the final bulk methanator is passed to a trim methanator train where it is subjected to further methanation. A recycle stream is removed downstream of the first, second or subsequent bulk methanator, and, in any order, passed through a compressor, subjected to cooling and then supplied to a trim and/or recycle methanator for further methanation before being recycled to the first and/or second and/or subsequent methanator.

8 Claims, 4 Drawing Sheets

PROCESS FOR THE PRODUCTION OF SUBSTITUTE NATURAL GAS

The present invention relates to a process for the production of fuel gases suitable for use as a substitute natural gas (SNG) from a synthesis gas such as that produced by the partial oxidation of carbonaceous fuels such as oil or coal.

Various processes are known for producing SNG. One such process is described in U.S. Pat. No. 4,016,189. Here the feed gas is treated in a single high temperature bulk methanator followed by treatment in a single low temperature trim methanator. In this process all of the fresh feed is fed to the bulk methanator where a large proportion of the carbon oxides are methanated to methane. Since the reaction is highly exothermic, a thermal mass is required to limit the temperature rise across the bulk methanator to an acceptable level. This thermal mass is supplied in the form of a recycle gas which is taken from downstream of the bulk methanator but prior to the trim methanator. The recycle stream is compressed prior to being fed upstream of the bulk methanator.

The single stage of trim methanation described in U.S. Pat. No. 4,016,189 is adequate to produce a low calorific gas with a methane content of 60%. This is below the required methane level for current SNG product specifications.

In general it should be noted that a bulk methanator is one which receives part or all of the carbon monoxide rich feed, i.e. fresh feed to the plant. A trim methanator is one that does not receive any fresh carbon monoxide feed and carries out trim methanation, often at lower temperature than in the bulk methanator. For the purposes of the present invention, a recycle methanator is one which is contained within the recycle loop and which does not receive fresh carbon monoxide rich feed.

An alternate process is suggested in U.S. Pat. No. 4,205,961. This process aims to optimise the plant by reducing the operating costs thereof. This is achieved by increasing the number of bulk methanators. Specifically, the bulk methanation duty is split between two reactors. Fresh feed is fed to both the first and the second bulk methanator. The stream taken from the first bulk methanator is split with a portion being recycled via a compressor to the first bulk methanator with the remainder being passed to the second bulk methanator. The stream removed from the second bulk methanator is passed to the trim methanator.

Splitting the duty between the two bulk methanators essentially means that less of the overall bulk duty is carried out in the first bulk methanator. As the recycle is only around the first bulk methanator the recycle flowrate need only be sufficient to control the temperature rise across this bed. The lower duty means that there is a lower heat of reaction which must be removed by the recycle gas which in turn results in a lower recycle flowrate. The gas passing forward from first bulk methanator to the second bulk methanator acts as the thermal mass to quench the second stage of the bulk reaction. In the flowsheet described in U.S. Pat. No. 4,205,961 approximately 70% of the fresh feed is passed to the first bulk methanator with the remainder being passed to the second bulk methanator. The second bulk methanator has the effect of reducing the recycle flowrate by approximately 30% whilst maintaining the same recycle loop pressure drop. This has the benefit in a reduction in the recycle compressor power requirement but is at the expense of a second methanator reactor. The product gas produced by the process described in U.S. Pat. No. 4,205,961 does not achieve the current requirements for SNG specifications.

Various alternative processes are described in U.S. Pat. No. 4,133,825. Unlike other processes where a shift section was included upstream of the methanation unit, the process described here introduced the concept of shifting and methanating the raw gas over the methanation catalyst and within the methanation unit. This does result in an excess of carbon dioxide in the product and it is therefore necessary to include a carbon dioxide removal unit downstream of the methanation unit. Carrying out the shift reaction within the methanation unit requires large quantities of steam. It is therefore proposed to include a saturator upstream of the methanation section in order to simultaneously saturate and heat the feed stream with steam prior to bulk methanation. This not only provides the required steam for the shift reaction over the methanation catalyst but also prevents carbon formation on the catalyst.

In one arrangement, two bulk methanators are used with a proportion of the feed being passed to the first bulk methanator and the remainder to the second bulk methanator. The entire stream removed from the first bulk methanator is passed to the second bulk methanator and the recycle is taken after the second bulk methanator. Having been passed through a compressor, the recycle stream is passed to the first bulk methanator. The portion of the stream taken from the second bulk methanator which is not used as recycle is passed to trim methanators. In alternative processes, more than two bulk methanators are described and the raw feed is split between all of the bulk methanators present. The recycle is then taken from after the last bulk methanator.

Carrying out the shift reaction within the methanation unit negates the need for a separate shift section. However, as the flowrate through the methanation unit is much larger, as there is a large mass of carbon dioxide which passes from the feed to the product without undergoing any reaction, the amount of catalyst required is increased and the size of all of the equipment items except the compressor is also increased. This is because the carbon dioxide provides a large thermal mass to remove heat from the bulk system and hence a large recycle is not required.

A still further alternative process is described in U.S. Pat. No. 4,298,694. In this process a dual catalyst is used to reduce the operating cost of the SNG plant by reducing the compressor recycle power. This is achieved by reducing the temperature of the inlet to the bulk methanator and so for the same bulk methanator outlet temperature, a larger temperature rise across the bed is allowed. This means that more of the heat of reaction can be used to increase the bed temperature. This results in a lower required thermal mass of gas to soak up the heat released through reaction and hence a lower recycle flowrate.

The nickel based methanation catalyst used in U.S. Pat. No. 4,298,694 does not operate stably below about 320° C. Hence, in order to reduce the inlet temperature to the methanator a shift catalyst, comprising at least two of copper, zinc and chromium, is placed above the methanation catalyst. This carries out a partial shift of the feed gas at a low temperature. The exothermic shift reaction is used to preheat the feed to the methanation catalyst and to reduce the amount of shifting that is carried out by the high temperature methanation catalyst. The total duty of the reactor is similar whether or not the shift catalyst is present. However, its presence allows the temperature into the reactor to be lower.

Thus loading a shift catalyst on top of the methanation catalyst has a massive impact on reducing the recycle flowrate and ultimately the power requirement of the recycle compressor as the allowable temperature rise across the combined catalyst bed is higher.

Whilst at initial running this process offers various advantages, the methanation catalyst normally operates at elevated temperatures of from about 500° C. to about 800° C. while the shift catalyst operates at lower temperatures of from about 250° C. to about 350° C. Thus at high temperatures, such as the equilibrium temperatures at which the methanation catalyst operates, the shift catalyst may become deactivated. If the shift catalyst becomes deactivated the inlet temperature must be raised or the shift catalyst replaced. Raising the inlet temperature due to shift catalyst inactivity negates the advantage of incorporating the shift catalyst and when deactivated, catalyst replacement will require a costly shutdown of the plant and the cost of the shift catalyst replacement.

A still further process is discussed in US2009/0247653. This suggests that methanation is favoured by lower temperatures and reduced water content. The proposed arrangement, which has two bulk methanators, is to reduce the temperature of the gas stream at the exit of the second bulk methanator in order to condense out a portion of the water in the stream. The partially dried gas stream is then split between the recycle stream, which is compressed and recycled back to the inlet of the first bulk methanator, and the stream to the trim methanator section.

It is suggested that the advantage of this process is to reduce the number of trim methanators required to achieve the required product specification as the reduction in the number of trim methanators will inevitably reduce the plant capital costs. There is also a slight saving on power demand due to the lower recycle compressor inlet temperature and lower recycle rate due to the lower water content.

However, in order to prevent carbon laydown on the catalyst in the bulk methanation section, there is a required minimum water content in the stream exiting the bulk methanators. Decreasing the temperature into the recycle compressor decreases the water content in the recycle stream and hence the composition of the gas exiting the bulk methanator is in the carbon forming region.

In order to prevent carbon laydown on the catalyst, steam is added to the recycle stream upstream of the bulk methanator. The large quantity of steam addition that is required impacts on the steam export from the plant which has a substantial effect on the economics there. In addition, reducing the temperature of the stream leaving the bulk methanator unit to condense out water only to then reheat the stream and add water is thermally inefficient.

A still further proposal is identified in US 2009/0264542. The aim of the described process is to provide a more cost-effective process by reducing the required power for the recycle compressor. This is achieved by splitting the carbon oxide rich feed to a series of bulk methanators and recycling the product gas from the exit of the first bulk methanator back to the inlet of the first bulk methanator. Increasing the number of bulk methanators decreases the required recycle rate and maintaining the recycle only around a single methanator reduces the pressure differential. The combined effect is to reduce the power of the recycle compressor. Although the compressor power is reduced, this is at the expense of the capital cost of the plant due to the requirement for an increased number of expensive refractory lined methanation reactors and the associated heat exchangers.

It can therefore be seen that the basic technology has remained substantially unchanged since the 1970s. The technology is well understood and the main proposals for improvements seen in recent years have centered on improving the economics of the process both in terms of capital costs and operating costs. Capital cost savings are achieved by reducing the number of methanators and catalyst volumes required to produce the desired product. Operational cost savings are achieved by reducing the power demand of the recycle compressor and increasing the heat recovery. Improved heat recovery increases the export steam from the plant and hence improves the economics of the plant.

Whilst some proposals successfully decrease the operational costs of the plant, this is at the expense of substantially increasing the capital costs thereof. Other proposals have decreased capital costs but at the expense of increased operational costs.

There is therefore a need for a process which has reduced operating costs, particularly in terms of the recycle compressor size and power, while not significantly increasing the amount of catalyst required and the number of reactors and which preferably also has low capital costs.

It has now been found that an improved process can be provided if the feed to a first and/or second and/or subsequent bulk methanator is cooled with a recycle gas which has been subjected to reaction in a trim and/or recycle methanator.

Thus according to the present invention there is provided a process for the production of substitute natural gas comprising:

- providing a feed gas to a first and/or second and/or subsequent bulk methanator;
- subjecting that feed gas to methanation in the presence of a suitable catalyst;
- removing an at least partially reacted stream from the first bulk methanator and supplying it to the second and/or subsequent bulk methanator where it is subjected to further methanation;
- passing a product stream from the final bulk methanator to a trim methanator train where it is subjected to further methanation;
- removing a recycle stream downstream of the first, second or subsequent bulk methanator, and, in any order, passing it through a compressor, subjecting it to cooling and then supplying to a trim and/or recycle methanator for further methanation before being recycled to the first and/or second and/or subsequent methanator.

The recycle is generally added to the first and/or second and/or subsequent bulk methanator via introduction into the feed line thereof. However, it may be added directly to the bulk methanator in a separate feed line.

In a first embodiment of the present invention, the process comprises:

- providing a feed gas to a first and second bulk methanator;
- subjecting that feed gas to methanation in the presence of a suitable catalyst;
- removing an at least partially reacted stream from the first bulk methanator and supplying it to the second bulk methanator where it is subjected to further methanation;
- removing a gas stream from the second bulk methanator and cooling said stream;
- splitting said cooled gas stream and supplying a portion to a trim methanator train where further methanation occurs and a portion to a recycle stream;
- passing said recycle stream to a compressor;
- passing said compressed stream from the compressor to a recycle methanator operated at a lower outlet temperature than the first and second bulk methanators and subjecting said compressed stream to further methanation; and
- recycling said stream from the recycle methanator to the first and/or second bulk methanator.

The process of this first embodiment reduces the power demand of the recycle compressor. Without wishing to be bound by any theory there are two main factors which control the power of the recycle compressor. These are the recycle flowrate and the pressure differential across the recycle compressor. The process of this first embodiment reduces the recycle flowrate by methanating the recycle stream further thus increasing the methane content of the stream and decreasing the carbon monoxide content of the stream. The amount of methanation carried out in the recycle methanator may be removed from the duty of the bulk methanators.

The trim methanator train may comprise one or more trim methanators. Where more than one trim methanator is present, they will generally be located in series. Where more than one trim methanator is used, they may be operated at the same temperature or the temperature may be lower in the second and any subsequent trim methanator(s) than in the first trim methanator. Where there are a plurality of trim methanators the temperature may be reduced in each subsequent trim methanator relative to the preceding methanator.

In one arrangement of this embodiment, a second recycle stream may be removed from the stream exiting the, or the first, trim methanator or a subsequent methanator, said trim recycle stream may be combined with the recycle stream from the second and/or subsequent bulk methanator before it is provided to the compressor. In alternative arrangements, recycle streams may be taken from other trim methanators in the trim methanator train or may be taken from a trim methanator other than the first.

The portion of the feed gas fed to the first bulk methanator and the second and/or subsequent bulk methanator may be the same or different. In one arrangement with two bulk methanators about 40% of the fresh feed gas is fed to the first bulk methanator, with the remainder being fed to the second bulk methanator. However, it will be understood that the split of feed between the methanators will depend on the number of bulk methantors, the operating conditions and the feed composition.

The first and second bulk methanators will be operated at any suitable reaction conditions. Suitable reaction temperatures include those from about 250° C. to about 700° C. inclusive.

The first trim methanator may be operated at a lower temperature than the bulk methanators.

The recycle methanator may be operated at a lower temperature than the bulk methanators. Suitable reaction temperatures include those from about 220° C. to about 550° C. inclusive.

In general, the outlet temperature of the recycle and trim methantor will be lower than the outlet temperature of the upstream methanator which provides the feed to the recycle or trim methanator.

As the recycle methanator operates at a lower outlet temperature than the bulk methanators, this converts a high proportion of the remaining carbon monoxide and hydrogen in the recycle stream to methane. The amount of reaction duty carried out by the recycle methanator reduces the duty from the bulk methanation section. A lower bulk methanation duty results in a lower required recycle flowrate.

Whilst the recycle methanator has been described as a separate methanator, it will be understood that the recycle methanator may be located as a stage in the vessel housing the first bulk methanator, and/or the second and/or subsequent bulk methanator if the recycle is to be added there. In this arrangement the feed will be added between the portion of the reactor in which recycle methanation is occurring and the bulk methanator. The process may be arranged such that the position of feed inlet is varied as the catalyst becomes deactivated. In one arrangement, the direction of flow may be reversed such that the catalyst bed which was the recycle methanator becomes the bulk methanator and that which was the bulk methanator becomes the recycle methanator.

Placing the recycle methanator into the recycle loop may reduce the recycle compressor power consumption by 4 to 5% over prior art processes such as that described in U.S. Pat. No. 4,133,825 in which two bulk methanation stages are used and with the recycle being taken from the exit of the second stage and returned upstream of the first stage.

In prior art processes, two sets of two parallel bulk methanators may be used due to vessel shipping restrictions. The method of the present invention may reduce the number of methanators that the plant requires and reduce the size of the equipment in the loop which results in a reduction in the overall capital cost. The bulk methanator size and/or loop pipework are often the factor(s) determining the number of trains required for an overall complex. The inclusion of a recycle methanator reduces the loop throughput and correspondingly reduces the bulk methanator and loop pipework sizes. The recycle methanator has the potential to reduce the number of trains required in an overall complex, which would present an even more significant reduction of the overall capital cost.

It is acknowledged that adding the recycle methanator, associated heat exchanger and lines increases the pressure drop of the recycle loop. However, the increase in pressure ratio is only slight and when compared with the saving in recycle flowrate results in a decrease in recycle compressor power.

In a second embodiment, the process comprises:

providing a feed gas to a first and second bulk methanator;

subjecting the feed gas to methanation in the presence of a suitable catalyst;

removing an at least partially reacted stream from the first bulk methanator and supplying it to the second bulk methanator where it is subjected to further methanation;

removing a gas stream from the second bulk methanator and cooling said stream;

supplying said cooled gas stream to a trim methanator where further methanation occurs, said trim methanator operating at a lower outlet temperature than the bulk methanators;

splitting the product stream from the trim methanator and passing a portion thereof to a train of subsequent trim methanators and a portion to a recycle stream;

passing said recycle stream to a compressor; and recycling said stream to the first and/or second bulk methanator.

This is a variation on the above first embodiment. Again the process serves to reduce the power demand of the recycle compressor. In this arrangement, the recycle flowrate is reduced by removing the recycle downstream of a trim methanator rather than upstream thereof. The stream exiting the trim methanator has been subjected to further methanation which has thereby increased the content of methane in the stream and decreased the carbon monoxide content of the stream.

The trim methanator may be one or more trim methanators in series. Where more than one trim methanators are present, the recycle stream may be taken after any trim methanator. The train of subsequent trim methanators may comprise one or more trim methanators. These will generally be located in series. The temperature in the subsequent trim methanator(s) may be lower than that in the first trim methanator(s). Where there are a plurality of trim methanators each methanator may be operated at a temperature which is lower than that of its predecessor.

In this second embodiment the overall bulk methanation duty is reduced as a part of it has been carried out in the trim methanator from which the recycle stream is taken. This therefore requires a lower recycle flowrate than conventional processes such as that described in U.S. Pat. No. 4,133,825. This process may also require fewer equipment items added to the recycle loop which results in a lower pressure differential across the compressor when compared to the above first embodiment for the same flowrate.

Another advantage of this embodiment of the present invention is that since the methanation is carried out upstream of the compressor then the number of moles of gas and hence the volumetric flowrate through the compressor is greatly reduced. Thus the power and suction volume, which set the size of the compressor, is lower than that required in conventional process and in the above first preferred embodiment. Catalyst volumes will generally remain unchanged over prior art systems. Operating costs will be reduced but not at the expense of increased capital costs.

Taking the recycle stream from downstream of the first trim methanator reduces the recycle compressor power consumption by 21 to 22% over prior art processes such as that described in U.S. Pat. No. 4,133,825 operating with two bulk methanation stages and with the recycle being taken from the exit of the second stage and returned upstream of the first stage. This is achieved by greatly reducing the volumetric flowrate at the suction of the compressor. The reduction in bulk methanator duty may reduce the number of methanators required in comparison to prior art processes.

In one arrangement of this embodiment a second recycle stream may be taken between the second bulk methanator and the trim methanator.

Optionally, a recycle methanator may be incorporated in the recycle stream between the compressor and the introduction of the recycle stream to the first and/or second and/or subsequent bulk methanator. As discussed above in connection with the first embodiment of the present invention, the recycle methanator may be located as a zone in the same vessel as the first bulk methanator or of any bulk methanator into which the recycle stream is to be introduced.

Methanating the recycle stream in the trim methanator before it is passed to the compressor substantially reduces the number of moles that the compressor must compress to achieve the required heat sink for the bulk methanation and hence reduces the power consumption.

Where a recycle methanator is present in the recycle loop, more than one recycle methanator may be present.

In a third embodiment, the process comprises:

providing a feed gas to a first and second bulk methanator;

subjecting the feed gas to methanation in the presence of a suitable catalyst;

removing an at least partially reacted stream from the first bulk methanator and supplying it to the second bulk methanator where it is subjected to further methanation;

removing a gas stream from the second bulk methanator and cooling said stream;

passing at least a portion of the cooled stream to a compressor;

supplying said compressed stream to a recycle methanator where further methanation occurs;

splitting the product stream from the recycle methanator and passing a portion thereof to a trim methanator train where it is subjected to further methanation; and recycling the balance of said product stream to the first and/or second bulk methanator.

This arrangement is a variation of the first embodiment described above. Although in this arrangement, the power demand of the recycle compressor is not reduced, it does enable the overall equipment count of the flowsheet to be reduced and hence reduce the overall capital costs. In this embodiment, the stream exiting the recycle methanator has been subjected to compression as well as the further methanation discussed above in connection with the first embodiment.

This third embodiment may be used to reduce the effective overall pressure drop of the methanation unit, without adding on costly equipment items, such as an extra compressor or extra methanation stages, which would have been required to pressurise the methanated gas. The configuration of this embodiment also uses the advantages of the increased pressure of operation for the trim methanation section, which will drive the equilibrium to produce more methane at the same temperature conditions.

In the above processes, the portion of the feed gas fed to the first bulk methanator, the second bulk methanator may be the same or different. In one arrangement with two bulk methanators about 40% of the fresh feed gas is fed to the first bulk methanator, with the remainder being fed to the second bulk methanator. However, it will be understood that the split of feed between the methanators will depend on the number of bulk methantors, the operating conditions and the feed composition.

Features described in connection with the above first or second embodiment may be combined with this embodiment as appropriate.

Whilst the above processes have been discussed with reference to there being two bulk methanators, it will be understood that in certain circumstances it may be appropriate to use more than two bulk methanators. In this arrangement, the recycle will generally be taken downstream of the last bulk methanator and the recycle stream, having been passed through a reactor and a compressor in any order, will be recycled to one or more of the bulk methanators as appropriate.

The feed to the bulk methanators may be stoichiometric or may be non-stoichiometric.

In any embodiment of the present invention, water may be removed from the recycle stream. Where water is to be removed it will generally be removed prior to the recycle stream being passed to the compressor. Generally water removal will only be required with some feed compositions and operating conditions.

In one arrangement of either preferred embodiment of the present invention the feed from the first bulk methanator to the second bulk methanator may be passed through a catalyst bed located above the catalyst bed over which the bulk methanation occurs and above the point at which the feed is added to the vessel. The stream passing from the first bulk methanator will then be subjected to trim methanation before it is mixed with the new feed and subjected to bulk methanation.

The shift reaction will generally be carried out before the feed is supplied to the bulk methanators but in an alternative arrangement, the shift reaction may be carried out in the bulk methanator.

Both preferred embodiments of the present invention reduce the overall operating cost of the plant by reducing the power of the recycle compressor.

With the processes of the present invention it is possible to move more of the catalyst to the trim methanators from the bulk methanators which is advantageous as catalyst life is generally longer here since there is reduced poisoning and the lower temperatures reduce the risk of sintering.

Whichever embodiment of the present invention is used, it may be desirable to add a small amount of steam into the recycle flow upstream of the bulk methanation stages to prevent carbon laydown on the catalyst. However, even when present this flowrate is small when compared to the overall steam production in the bulk methanators and is typically less than 5% of the total steam produced.

In one arrangement, steam may be introduced into the system stream via a feed saturator placed upstream of the bulk methanators. Thus the steam can be added without using direct steam addition.

The fresh feed to the first and/or second and/or subsequent bulk methanators of the present invention may be stoichiometric with respect to the methanation reaction or non-stoichiometric.

The present invention will now be described by way of example with reference to the accompanying drawings in which.

It will be understood by those skilled in the art that the drawings are diagrammatic and that further items of equipment such as feedstock drums, pumps, vacuum pumps, compressors, gas recycling compressors, temperature sensors, pressure sensors, pressure relief valves, control valves, flow controllers, level controllers, holding tanks, storage tanks and the like may be required in a commercial plant. Provision of such ancillary equipment forms no part of the present invention and is in accordance with conventional chemical engineering practice.

Figure 1:
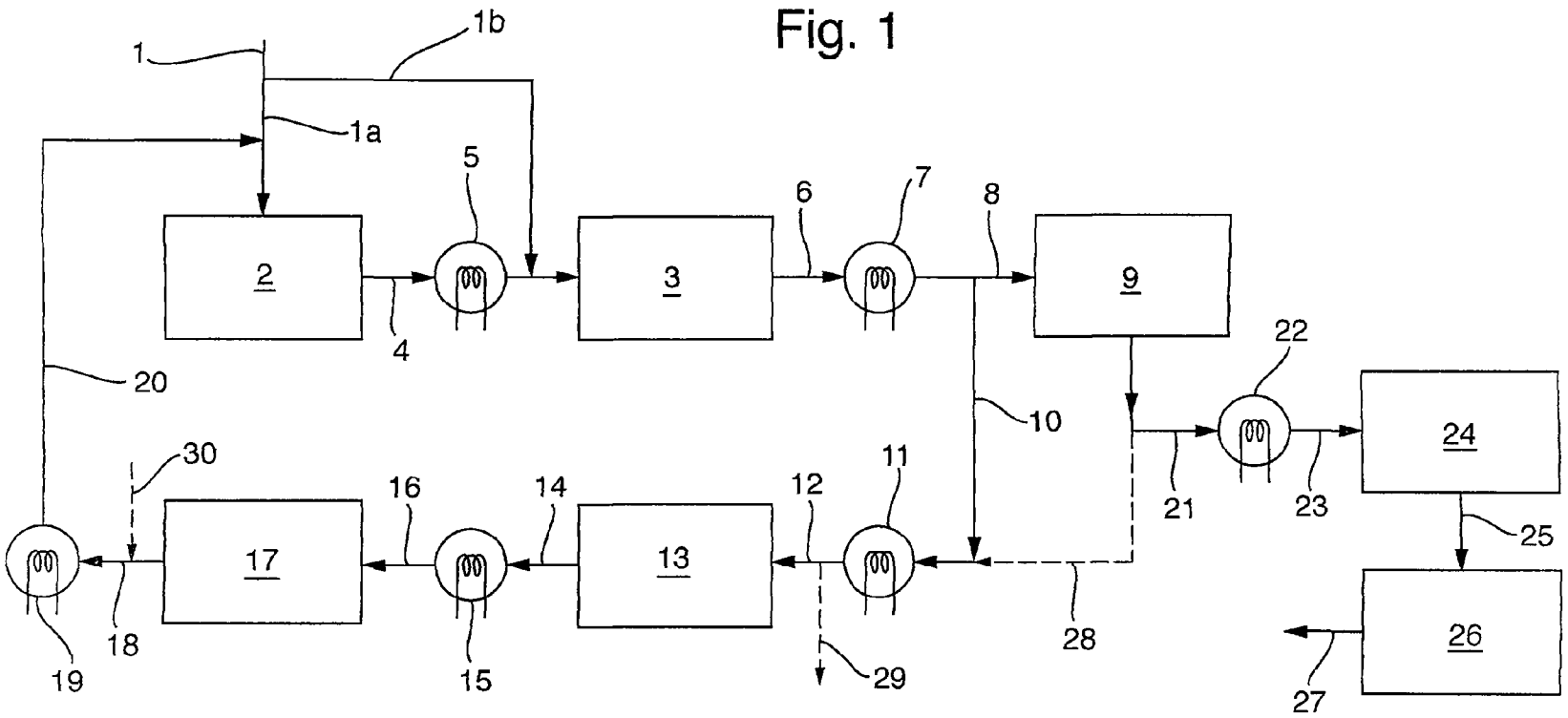
FIG. 1 is a block flow diagram of a first embodiment of the present invention.

One embodiment of the present invention is illustrated in FIG. 1. Desulphurised feed gas rich in carbon monoxide is fed in line 1 to the bulk methanation section which consists of two bulk methanators, the first bulk methanator 2 and the second bulk methanator 3. Thus the feed is split with a portion being fed in line 1*a* to the first bulk methanator 2 and a portion via line 1*b* to the second bulk methanator 3. The product stream from the first bulk methanator 2 is passed in line 4 to the second bulk methanator 3. It will generally be cooled in heat exchanger 5 before being added to the second bulk methanator 3.

The product stream from the second bulk methanator 3 is passed in line 6 to heat exchanger 7 where it is cooled. A portion of the stream from the heat exchanger is passed in line 8 to a first trim methanator 9. The remainder of the stream from the heat exchanger 7 is passed in line 10, via heat exchanger 11 and line 12 to the compressor 13. In heat exchanger 11 the recycle stream is cooled before compression in compressor 13.

The gas from the compressor is passed in line 14 via heat exchanger 15 where it is heated to recycle methanation operating temperatures and line 16 to the recycle methanator 17 where it is subjected to further methanation reaction. The gas from the recycle methanator is removed from the recycle methanator in line 18, passed through heat exchanger 19 and returned via line 20 to the first methanator 2. Generally this return to the first methanator 2 will be via the feed line 1*a*.

The product from the trim methanator 9 is removed in line 21 and passed through heat exchanger 22 where it is cooled. It is then passed in line 23 to one or more subsequent trim methanators 24. The product is withdrawn in line 25 and then is cooled and dried at 26. The SNG is then removed in line 27.

In one specific example the bulk methanators may be operated such that the feed thereto is at about 320° C. After the reaction and subsequent heat exchange the feed to the first trim methanator 9 will be at about 280° C. The feed to the recycle methanator 17 will also be about 280° C. The feed to the subsequent trim methanators 24 will generally be about 250° C.

In the flow sheet illustrated in FIG. 1, a portion of the stream removed from the first trim methanator 9 can be added in line 28 to the recycle stream fed to the compressor 13 and hence to the recycle methanator 17.

Depending on the feed composition and the operating conditions, it may be necessary or desirable to remove water. This can be conveniently done before the compressor in line 29.

Stream may be added in line 30. This will only be required with some feed compositions and operating conditions.

Figure 2:
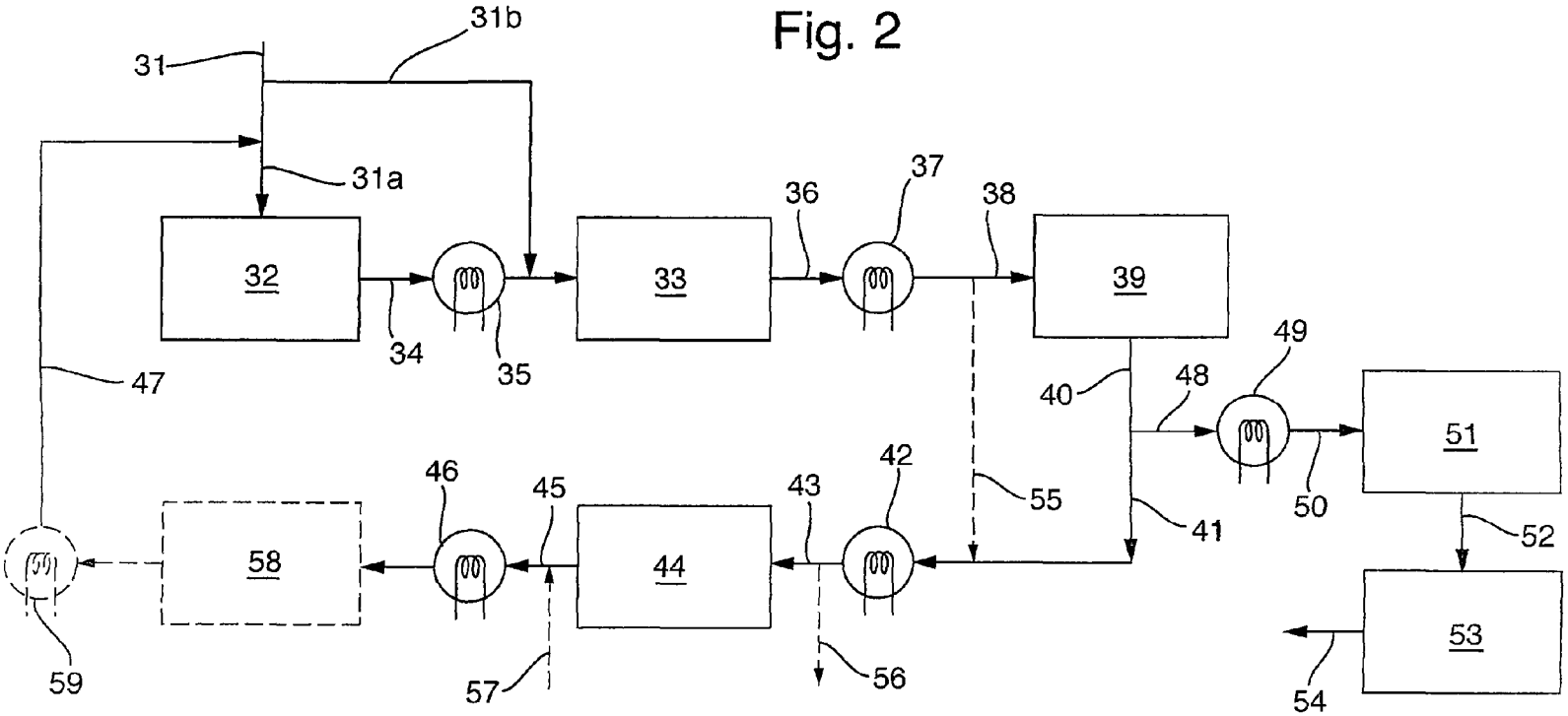
FIG. 2 is a block flow diagram of a second embodiment of the present invention.

A second embodiment of the present invention is illustrated in FIG. 2. Desulphurised feed gas rich in carbon monoxide is fed in line 31 to the bulk methanation section which consists of two bulk methanators, the first bulk methanator 32 and the second bulk methanator 33. Thus the feed is split with a portion being fed in line 31*a* to the first bulk methanator 32 and a portion via line 31*b* to the second bulk methanator 33. The product stream from the first bulk methanator 32 is passed in line 34 to the second bulk methanator 33. It will generally be cooled in heat exchanger 35 before being added to the second bulk methanator 33.

The product stream from the second methanator 33 is passed in line 36 to heat exchanger 37 where it is cooled. The stream from the heat exchanger 37 is passed in line 38 to a first trim methanator 39. Following methanation in the trim methanator 39, the stream is removed in line 40 with a portion being passed in line 41 via heat exchanger 42 and line 43 to the compressor 44. In heat exchanger 42 the recycle stream is cooled in order to achieve the required steam to carbon ratio in the bulk methanation section. Since the stream taken from the trim methanator 39 has been methanated further and at lower temperature it has a lower carbon monoxide and hydrogen content and a higher methane content than the gas exiting the second bulk methanator 33.

The gas from the compressor is passed in line 45 via heat exchanger 46 where it is heated before being passed in line 47 to the bulk methanator 32. Generally this return to the first methanator 32 will be via the feed line 31*a*.

The portion of the stream from the trim methanator 39 which is not passed to the compressor 44 is removed in line 48 and passed through heat exchanger 49 where it is cooled. It is then passed in line 50 to one or more subsequent trim methanators 51. The product is withdrawn in line 52 and then is cooled and dried at 53. The SNG is then removed in line 54.

In one specific example the bulk methanators may be operated such that the feed thereto is at about 320° C. After the reaction and subsequent heat exchange the feed to the first trim methanator 39 will be at about 280° C. The feed to the subsequent trim methanators 51 will generally be about 250° C.

In the flow sheet illustrated in FIG. 2, a portion of the stream removed from the heat exchanger 37 may be removed and having by-passed the first trim methanator 39 can be added in line 55 to the recycle stream fed to the compressor 44 and hence to the bulk methanator 32.

Depending on the feed composition and the operating conditions, it may be necessary or desirable to remove water. This can be conveniently done before the compressor 44 in line 56.

Steam may be added in line 57. This will only be required with some feed compositions and operating conditions.

Optionally, a recycle methanator 58 and subsequent heat exchanger 59 may be located in the recycle loop after the compressor 44.

In one specific example of this embodiment the bulk methanators may be operated such that the feed thereto is at about 320° C. After the reaction and subsequent heat exchange the feed to the first trim methanator 39 will be at about 280° C. The feed to the recycle methanator 58, where present, will also be about 280° C. The feed to the subsequent trim methanators 51 will generally be about 250° C.

Optionally, the recycle methanator, where present, may be combined within the same vessel as the bulk methanator into which the recycle stream is to be added. This is illustrated schematically in FIG. 3. The arrangement illustrated in FIG. 3 also includes the possibility that the second bulk methanator also has a pre-reactor for the methanation of cooling gas located in the upper portion of the vessel. It will however be understood that these two arrangement may be used alone or in combination.

Figure 3:
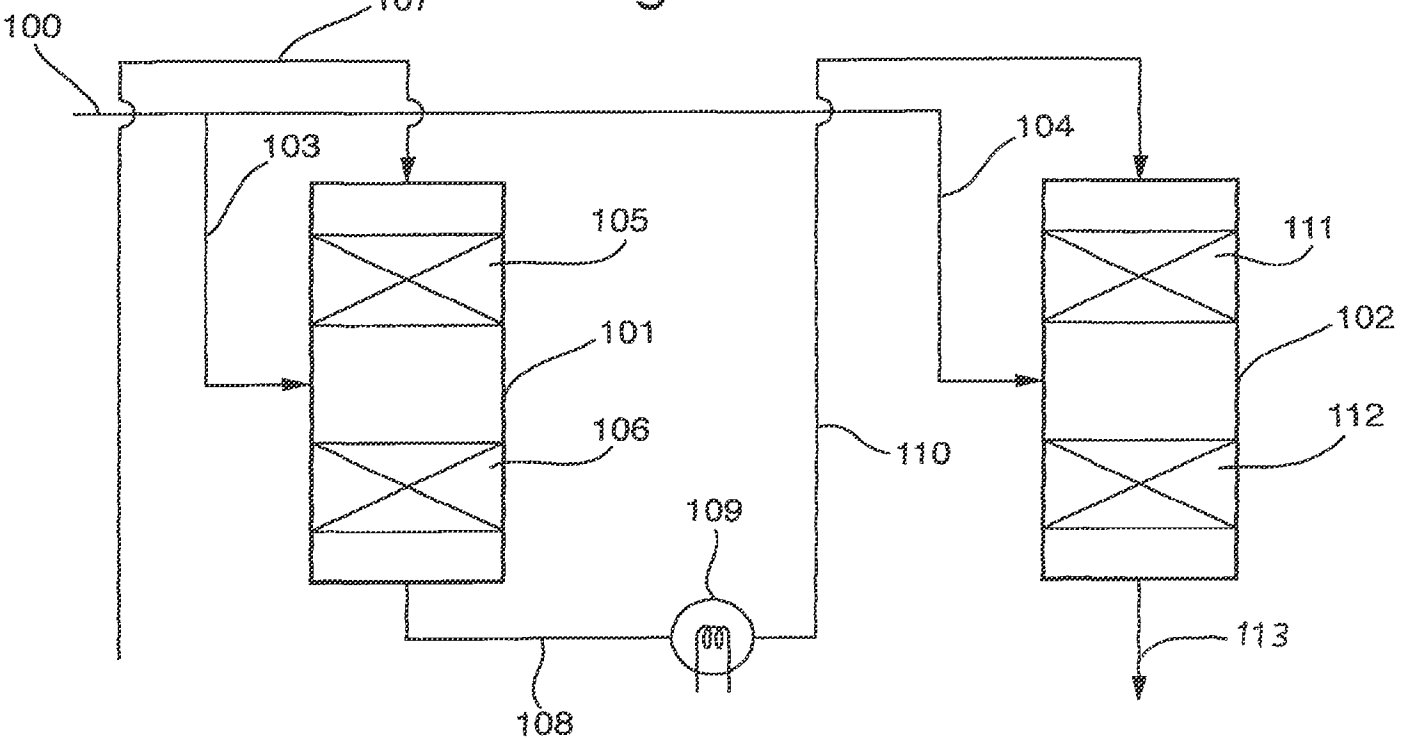
FIG. 3 is a schematic representation of the arrangement in which the recycle methanator is combined in the same vessel as the first bulk methanator.

As illustrated in FIG. 3, the fresh feed is fed in line 100. This is split and added to vessels 101 and 102 respectively via lines 103 and 104. Vessel 101 comprises two reaction zones 105 and 106 and the feed is added between these two zones. Since flow is downwardly the feed added in line 103 will flow through reaction zone 106 where it is contacted with the methanation catalyst at the required temperature for bulk methanation.

Recycle from the compressor (not shown in this figure) is added to the vessel 101 in line 107. It flows downwardly through reaction zone 105 which acts as the recycle methanator and undergoes methanation before being mixed with the gaseous feed added in line 103.

Product from the bulk methanation is removed in line 108 and passed to heat exchanger 109 where it is cooled before being passed to the second bulk methanator. This may be a conventional bulk methanator or may be the vessel 102 illustrated in FIG. 3. In this arrangement the stream from the first bulk methanator is added in line 110 to the top of the vessel where it is passed through a catalyst bed 111 and undergoes methanation before being mixed with the fresh feed added in line 104 before being passed to catalyst bed 112 where bulk methanation occurs. The product is then removed in line 113 before being removed for treatment in accordance with the present invention.

Figure 4:
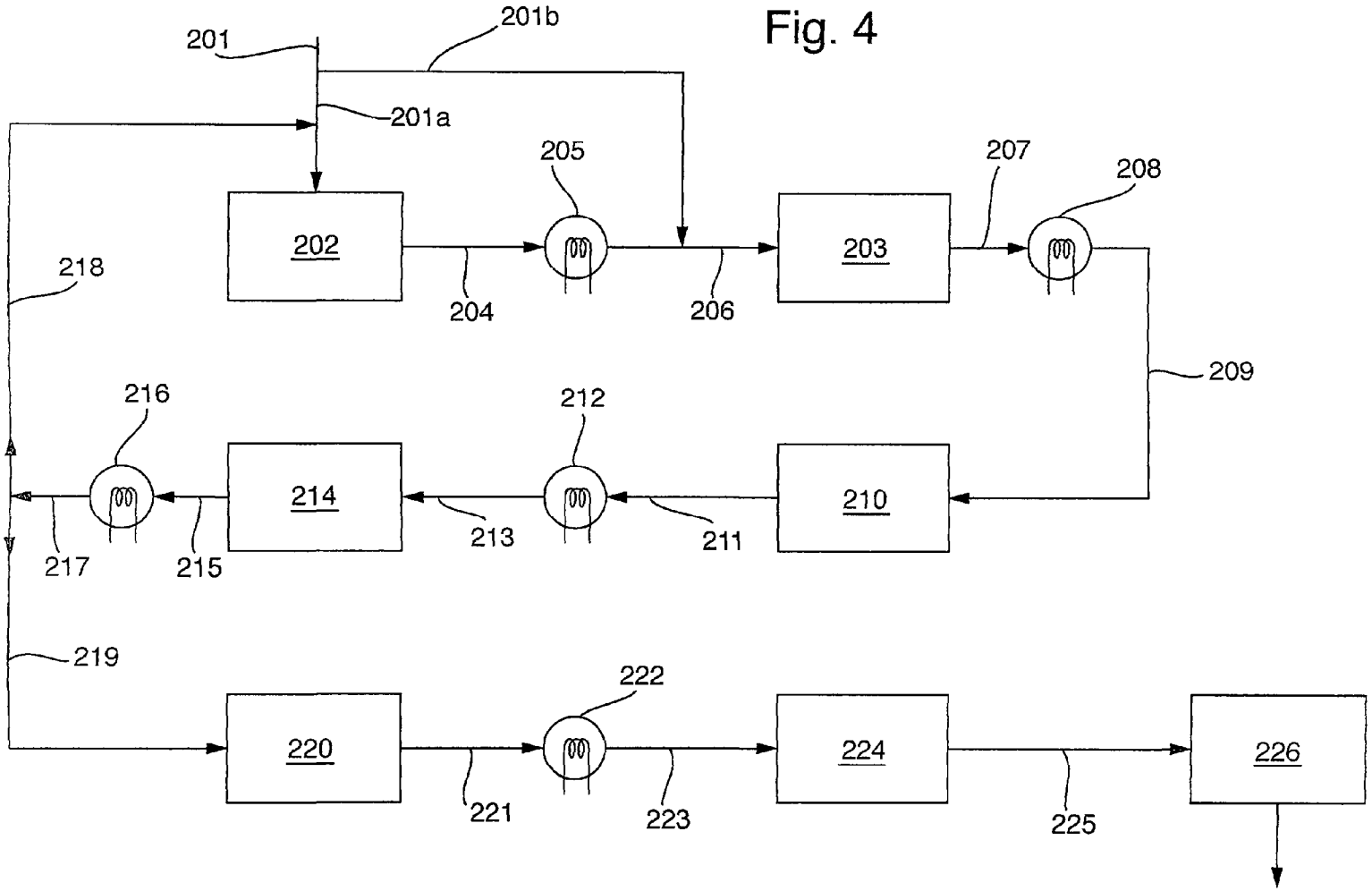
FIG. 4 is a schematic representation of the third embodiment of the present invention.

An alternative arrangement of the present invention is illustrated in FIG. 4. Desulpharised feed rich in carbon monoxide is fed in line 201 to the bulk methanation section which consists of two bulk methanators, the first bulk methanator 202 and the second bulk methanator 203. Thus the feed is split with a portion being fed in line 201*a* to the first bulk methanator 202 and a portion via line 201*b* to the second bulk methanator 203. As discussed below, this is not fed directly to the second methanator 203 but is first mixed with a product stream from the first methanator 201

The product stream from the first bulk methanator 202 is passed in line 204 to heat exchange 205 where it is cooled. This is then passed in line 206 to the second methanator 203. Prior to being added to the methanator, the stream is mixed with feed added in line 201*b*.

The product stream from the second methanator 203 is passed in line 207 to heat exchanger 208 where it is cooled. The stream from the heat exchanger is passed in line 209 to compressor 210 where it is compressed. The gas from the compressor is passed in line 211 to heater 212 where it is heated to recycle methanation operating temperatures before being passed in line 213 to recycle methanator 214 where it is subjected to further methanation reaction.

The product stream from the recycled methanator 214 is removed in line 215 to cooler 216. The cooled stream is removed in line 217 before being split into lines 218 and 219. The portion in line 218 is recycled to the first methanator 202. The portion of the cooled stream in line 219 is passed to first trim methanator 220. The product from the first trim methanator 220 is passed in line 221 to cooler 222. The cooled stream is then passed in line 223 to the second trim methanator 224 before being passed in line 225 to dryer 226. The SNG is then removed in line 227.

The present invention will now be illustrated with reference to the following examples.

COMPARATIVE EXAMPLE A

The 'Base Case' flowsheet has two bulk methanators within the recycle loop followed by two stages of trim methanation which are not included in the recycle loop. The flowsheet uses a near stoichiometric feed and is designed to produce a product containing 96% methane. Table 1 summarises the main operating parameters for the flowsheet and gives details of the recycle flow, loop pressure drop and expected compressor power for this case.

TABLE 1

| | | |
|---|---|---|
| Bulk Methanators Inlet Temp | ° C. | 320 |
| Bulk Methanator 1 Inlet Pressure | Bara | 29.85 |
| Trim Methanator 1 Inlet Temp | ° C. | 280 |
| Trim Methanator 2 Inlet Temp | ° C. | 250 |
| Recycle Loop Flow | kg/h | 115,000 |
| | $Am^3/h$ | 10,358 |
| Recycle Loop Pressure Drop | Bar | 3.58 |
| Estimated Absorbed Compressor Power | MW | 1.34 |
| Final Product Pressure | Bara | 23.2 |
| Final Methane Composition (dry) | Mol % | 96.0 |

EXAMPLE A1

A recycle methanator has been added into the loop downstream of the recycle compressor. Two additional heat exchangers are also added into the recycle loop, the first to heat the feed to the recycle methanator to the correct temperature, and the second to cool the recycle methanator product. Again the flowsheet is designed to produce a product containing 96% methane. Table 2 summarises the main operating parameters for the flowsheet and gives details of the recycle flow, loop pressure drop and expected compressor power for this case.

TABLE 2

| | | |
|---|---|---|
| Bulk Methanators Inlet Temp | ° C. | 320 |
| Bulk Methanator 1 Inlet Pressure | Bara | 29.85 |
| Recycle Methanator Inlet Temp | ° C. | 280 |
| Trim Methanator 1 Inlet Temp | ° C. | 280 |
| Trim Methanator 2 Inlet Temp | ° C. | 250 |
| Recycle Loop Flow | kg/h | 85,000 |
| | $Am^3/h$ | 7,552 |
| Recycle Loop Pressure Drop | Bar | 4.58 |
| Estimated Absorbed Compressor Power | MW | 1.28 |

This example shows that, despite the addition of the recycle methanator and associated heat exchangers into the recycle loop, the overall compressor power for this case is lower than for the base case flowsheet by approximately 5%. As some of the methanation duty that would normally be occurring in the bulk methanators has been transferred to the recycle methanator, the recycle rate that is required to control the temperature at the outlet of the bulk methanators is significantly reduced, resulting in the improvement in compressor power.

EXAMPLE A2

In this example, there are no additional methanators or other items of equipment added to the flowsheet, but the point at which the recycle is removed has been moved from the outlet of bulk methanator 2 to the outlet of trim methanator 1. i.e. trim methanator 1 is now included in the recycle loop. An additional trim methanator (trim methanator 2) is included outside of the recycle loop giving the same number of bulk and trim methanators overall as for the comparative example. The flowsheet is designed to produce a product containing 96% methane. Table 3 summarises the main operating parameters for the flowsheet and gives details of the recycle flow, loop pressure drop and expected compressor power for this case.

TABLE 3

| | | |
|---|---|---|
| Bulk Methanators Inlet Temp | ° C. | 320 |
| Bulk Methanator 1 Inlet Pressure | Bara | 29.85 |
| Trim Methanator 1 Inlet Temp | ° C. | 280 |
| Trim Methanator 2 Inlet Temp | ° C. | 250 |
| Recycle Loop Flow | kg/h | 86,813 |
| | $Am^3/h$ | 7,346 |
| Recycle Loop Pressure Drop | Bar | 3.97 |
| Estimated Absorbed Compressor Power | MW | 1.05 |

This example shows that, despite the addition of the trim methanator 1 into the recycle loop, the overall compressor power for this case is lower than for the base case flowsheet by over 20%. This example also shows a significant improvement over Example A1. As with the recycle methanator flowsheet of Example A1, the overall bulk methanation duty has been reduced (this time as a part of it has been carried out in trim methanator 1). The bulk methanation section then requires a lower recycle flowrate than the flowsheet of Comparative Example A. In addition, as an improvement on the design of Example A1, fewer equipment items are added to the loop which results in a lower pressure differential across the recycle compressor. Another major advantage of this arrangement is that the methanation in the trim methanator 1 is carried out upstream of the compressor so that the number of moles of gas and hence the volumetric flowrate into the compressor is greatly reduced ($3H_2+CO \rightarrow CH_4+H_2O$). Hence the power and suction volume (which set the compressor size) for this design is lower than both Comparative Example A and Example A1.

COMPARATIVE EXAMPLE B

This 'Base Case' flowsheet has two bulk methanators within the recycle loop followed by two stages of trim methanation which are not included in the recycle loop. The flowsheet uses a non-stoichiometric, carbon rich, feed and is designed to produce a product containing 97.5% methane after downstream OSBL $CO_2$ removal. Table 4 summarises the main operating parameters for the flowsheet and gives details of the recycle flow, loop pressure drop and expected compressor power for this case.

TABLE 4

| | | |
|---|---|---|
| Bulk Methanators Inlet Temp | ° C. | 320 |
| Bulk Methanator 1 Inlet Pressure | Bara | 29.85 |
| Trim Methanator 1 Inlet Temp | ° C. | 280 |
| Trim Methanator 2 Inlet Temp | ° C. | 250 |
| Recycle Loop Flow | kg/h | 285,445 |
| | $Am^3/h$ | 10,360 |

TABLE 4-continued

| | | |
|---|---|---|
| Recycle Loop Pressure Drop | Bar | 4.35 |
| Estimated Absorbed Compressor Power | MW | 1.60 |
| Final Product Pressure | Bara | 23.2 |

EXAMPLE B1

A recycle methanator has been added into the loop downstream of the recycle compressor. One additional heat exchanger is also added into the recycle loop, to cool the recycle methanator product. However the addition of this unit has allowed for the deletion of an exchanger upstream of the loop, consequently the loop and the product are at a higher pressure. Again the flowsheet is designed to produce a product containing 97.5% methane. Table 5 summarises the main operating parameters for the flowsheet and gives details of the recycle flow loop pressure drop and expected compressor power for this case.

TABLE 5

| | | |
|---|---|---|
| Bulk Methanators Inlet Temp | ° C. | 320 |
| Bulk Methanator 1 Inlet Pressure | Bara | 46.61 |
| Trim Methanator 1 Inlet Temp | ° C. | 280 |
| Trim Methanator 2 Inlet Temp | ° C. | 250 |
| Recycle Loop Flow | kg/h | 221,054 |
| | $Am^3/h$ | 7,928 |
| Recycle Pressure Drop | Bar | 5.30 |
| Estimated Absorbed Compressor Power | MW | 1.49 |

This example shows that, despite the addition of the recycle methanator and associated heat exchangers into the recycle loop; the overall compressor power for this case is lower than for the base case flowsheet by approximately 7%. As in Example A1, some of the methanation duty that would normally be occurring in the bulk methanators has been transferred to the recycle methanator, the recycle rate that is required to control the temperature at the outlet of the bulk methanators is significantly reduced, resulting in the improvement in compressor power.

EXAMPLE B2

In this example, there are no additional methanators or other items of equipment added to, or removed from, the flowsheet. However the point at which the recycle is removed has been moved from the outlet of bulk methanator 2 to the outlet of trim methanator 1, i.e. trim methanator 1 is now included in the recycle loop. Trim methanator 2 is included outside of the recycle loop giving the same number of bulk and trim methanators overall as for the comparative example. The flowsheet is designed to produce a product containing 97.5% methane. Table 6 summarises the main operating parameters for the flowsheet and gives details of the recycle flow, loop pressure drop and expected compressor power for this case.

TABLE 6

| | | |
|---|---|---|
| Bulk Methanators Inlet Temp | ° C. | 320 |
| Bulk Methanator 1 Inlet Pressure | Bara | 46.16 |
| Trim Methanator 1 Inlet Temp | ° C. | 280 |
| Trim Methanator 2 Inlet Temp | ° C. | 250 |
| Recycle Loop Flow | kg/h | 211,548 |
| | $Am^3/h$ | 7,145 |

TABLE 6-continued

| | | |
|---|---|---|
| Recycle Pressure Drop | Bar | 5.65 |
| Estimated Absorbed Compressor Power | MW | 1.43 |

This example shows that, despite the addition of the trim methanator 1 into the recycle loop, the overall compressor power for this is lower than for the base case flowsheet by over 10%. This example also shows an improvement over Example B1. Again, as in Example A2, the recycle methanator flowsheet, the overall bulk methanation duty has been reduced (this time as part of it has been carried out in trim methanator 1). The bulk methanation section then requires a lower recycle flowrate than the flowsheet of Comparative Example B.

As with Example A2, another major advantage of this arrangement is that the methanation in the trim methanator 1 is carried out upstream of the compressor so that the number of moles of gas and hence the volumetric flowrate into the compressor is greatly reduced ($3H_2+CO \rightarrow CH_4+H_2O$). Hence the power and suction volume (which set the compressor size) for this design is lower than both Comparative Example B and Example B1.

COMPARATIVE EXAMPLE C

The flowsheet uses a near stoichiometric feed and is designed to produce a product containing 96% methane as in Example A1. The flowsheet has been changed to include the full recycle flow through the recycle methanator. Table 7 summarises the main operating parameters for the flowsheet and gives details of the recycle flow loop pressure drop and expected compressor power for this case.

TABLE 7

| | | |
|---|---|---|
| Bulk Methanators Inlet Temp | ° C. | 320 |
| Bulk Methanator 1 Inlet Pressure | Bara | 29.85 |
| Trim Methanator 1 Inlet Temp | ° C. | 280 |
| Trim Methanator 2 Inlet Temp | ° C. | 250 |
| Recycle Loop Flow | kg/h | 236197 |
| | $Am^3/h$ | 12352 |
| Recycle Pressure Drop | Bar | 4.7 |
| Estimated Absorbed Compressor Power | MW | 3.49 |
| Final Product Pressure | Bara | 26.4 |
| Final Methane Composition (dry) | Mol % | 96.2 |

This example shows that, due to the addition of the recycle methanator and associated heat exchangers into the recycle loop, with the full recycle flow entering the compressor; the overall compressor power for this case is higher than for the base case flowsheet. However, this example demonstrates the application for this embodiment, increasing the product pressure and methane content without adding on any extra equipment items.

The invention claimed is:

1. A process for the production of substitute natural gas comprising:

providing a feed gas to a first and/or second and/or subsequent bulk methanator;

subjecting that feed gas to methanation in the presence of a suitable catalyst;

removing an at least partially reacted stream from the first bulk methanator and supplying said at least partially reacted stream to the second and/or subsequent bulk methanator where said at least partially reacted stream is subjected to further methanation;

passing a product stream from the final bulk methanator to a trim methanator train where said product stream is subjected to further methanation;

removing a recycle stream downstream of the first, second or subsequent bulk methanator, and, in any order, passing said recycle stream through a compressor, subjecting the recycle stream to cooling and then supplying said recycle stream to a recycle methanator for further methanation before being recycled to the first and/or second and/or subsequent methanator.

2. A process according to claim 1 wherein the process comprises:

providing a feed gas to a first and second bulk methanator;

subjecting that feed gas to methanation in the presence of a suitable catalyst;

removing an at least partially reacted stream from the first bulk methanator and supplying said at least partially reacted stream to the second bulk methanator where said at least partially reacted stream is subjected to further methanation;

removing a gas stream from the second bulk methanator and cooling said stream;

splitting said cooled gas stream and supplying a portion to a trim methanator train where further methanation occurs and a portion to a recycle stream;

passing said recycle stream to a compressor;

passing said compressed stream from the compressor to a recycle methanator operated at a lower outlet temperature than the first and second bulk methanators and subjecting said compressed stream to further methanation; and recycling said stream from the recycle methanator to the first and/or second bulk methanator.

3. A process according to claim 2 wherein a second recycle stream is removed from the stream exiting the, or the first, trim methanator or a subsequent methanator.

4. A process according to claim 2 wherein the recycle methanator is located as a zone in the vessel housing the first bulk methanator, and/or the second bulk methanator.

5. A process according to claim 1 comprising:

providing a feed gas to a first and second bulk methanator;

subjecting the feed gas to methanation in the presence of a suitable catalyst;

removing an at least partially reacted stream from the first bulk methanator and supplying said at least partially reacted stream to the second bulk methanator where said partially reacted stream is subjected to further methanation;

removing a gas stream from the second bulk methanator and cooling said stream;

passing at least a portion of the cooled stream to a compressor;

supplying said compressed stream to a recycle methanator where further methanation occurs;

splitting the product stream from the recycle methanator and passing a portion thereof to a trim methanator where said product stream is subjected to further methanation; and recycling the balance of said product stream to the first and/or second bulk methanator.

6. A process according to claim 1 wherein water is removed from the recycle stream.

7. A process according to claim 1 wherein the feed from the first bulk methanator to the second and/or subsequent bulk methanator is passed through a catalyst bed located above the catalyst bed over which the bulk methanation occurs and above the point at which the fresh feed is added to the vessel.

8. A process according to claim 1 wherein the fresh feed to the first and/or second and/or subsequent bulk methanators is stoichiometric with respect to the methanation reaction or non-stoichiometric.

* * * * *